US005183276A

United States Patent [19]

Pratt

[11] Patent Number: 5,183,276

[45] Date of Patent: Feb. 2, 1993

[54] TRAINING WHEEL FOR IN-LINE SKATES

[75] Inventor: Kenneth W. Pratt, Ware, Mass.

[73] Assignee: Seneca Sports, Inc., Milford, Mass.

[21] Appl. No.: 827,421

[22] Filed: Jan. 28, 1992

[51] Int. Cl.[5] ..... A63C 17/06

[52] U.S. Cl. ..... 280/11.22; 280/11.19; 280/809

[58] Field of Search ..... 280/11.23, 11.22, 11.19, 280/11.27, 11.24, 11.25, 809

[56] References Cited

U.S. PATENT DOCUMENTS

| | | | |
|---|---|---|---|
| 301,676 | 7/1884 | Clark | 280/11.19 |
| 308,744 | 12/1884 | Brix | 280/11.27 |
| 1,694,374 | 12/1928 | Colwell | 280/11.22 |
| 2,259,346 | 10/1941 | Long | 280/11.23 |
| 4,273,345 | 6/1981 | Ben-Dor et al. | 280/11.22 |
| 4,310,168 | 1/1982 | Macaluso | 280/11.24 |
| 4,512,590 | 4/1985 | Stenvall | 280/11.23 |

FOREIGN PATENT DOCUMENTS

| | | | |
|---|---|---|---|
| 453425 | 9/1936 | United Kingdom | 280/11.22 |

OTHER PUBLICATIONS

Brody, Jane E., "Personal Health", *The New York Times*, (May 2, 1991), p. B14.

*Primary Examiner*—David M. Mitchell
*Attorney, Agent, or Firm*—Fish & Richardson

[57] ABSTRACT

A balance training apparatus for a roller transportation device having a series of in-line wheels positioned beneath the user's foot. The training apparatus has a U-shaped wheel well attached to the tandem roller skate for positioning a training wheel adjacent the roller wheels for rotation about an axis parallel with the axis of the roller wheel rotation and along a parallel, nonintersecting line of travel to the roller wheels when the roller wheels engage a travel surface at an acute angle.

18 Claims, 2 Drawing Sheets

TRAINING WHEEL FOR IN-LINE SKATES

FIELD OF THE INVENTION

This invention relates to skates having in-line or tandem rollers, also known as tandem roller skates.

BACKGROUND OF THE INVENTION

Skating on tandem roller skates has become a popular activity because it simulates the feel and motion of ice skating on dry land. Tandem roller skates typically consist of a boot, with a series of rotatable roller wheels mounted upon a bracket attached to the sole of the boot. The roller wheels, similar to the blade of a skate, are positioned by the bracket in a single line of travel. Also like ice skating, it often takes a new participant some time and practice to become fully acclimated to maintaining his or her balance above the roller wheels without falling.

SUMMARY OF THE INVENTION

According to one aspect of the invention, a training wheel device for use with a tandem or in-line roller skate having a series of travel rollers disposed for travel along a travel surface in a single travel line. The training wheel device comprises a training wheel bracket, a training wheel mounted upon the bracket, and means for mounting the device upon the tandem roller skate. The training wheel is adapted to engage upon the travel surface for travel in a balance line to enhance the balance of a user, the balance line being spaced from and generally parallel to the travel line of the travel rollers.

Preferred embodiments of this aspect of the invention may include one or more of the following additional features. The training wheel defines a wheel surface, and in a first position of the tandem roller skate with the travel rollers disposed in a plane generally vertical to a travel surface, the wheel surface is spaced from engagement with the travel surface, and in a second position of the tandem roller skate with the travel rollers disposed in a plane at a predetermined angle of inclination to a plane of the travel surface, the wheel surface is engaged upon the travel surface for enhanced user balance The bracket comprises a u-shaped member having a first leg, a second leg and a connecting member extending therebetween The u-shaped member defines a wheel well and the training wheel is mounted for rotation therein. The tandem roller skate further comprises a travel roller bracket and the travel rollers are mounted for rotation on parallel travel roller axles mounted on the travel roller bracket, the means for mounting the device upon the tandem roller skate comprises at least one elongated travel roller axle and the training wheel bracket defines an aperture for receiving the elongated travel roller axle therethrough. The means for mounting the device upon the tandem roller skate comprises two elongated travel roller axles and the training wheel bracket defines a pair of apertures for receiving the elongated travel roller axles therethrough. The at least one aperture of the pair of apertures comprises an elongated slot to accommodate a range of distances between the elongated travel roller axles. The training wheel is the same diameter as the roller wheels. The connecting member defines an aperture for extension of the training wheel therethrough, thereby to accommodate training wheels of various diameters.

According to another aspect of the invention, a personal roller transportation apparatus comprises a tandem roller skate having a foot sole member for supporting a user's foot, and a roller wheel mounting means for positioning a plurality of roller wheels in tandem in a first common roller plane beneath the foot sole member, the roller wheels being mounted on axles to maintain parallel axes for rotation in the first common roller plane along a travel line upon a travel surface, the travel line being generally centered with respect to the foot; and a training wheel device attached to the tandem roller skate for positioning a training wheel adjacent the roller wheels for rotation of the training wheel in a second training plane, the second plane lying parallel to the first plane, the training wheel disposed to rotate about an axis parallel with the axes of rotation of the roller wheels and in the second plane along a training line on the surface parallel and nonintersecting with the travel line, the training wheel being spaced from the travel surface when the first common roller plane is generally perpendicular to the travel surface, and adapted to engage the travel surface when the first common roller plane achieves a predetermined acute angle to the travel surface, thereby to aid a user to maintain balance.

Preferred embodiments of this aspect of the invention may include one or more of the following additional features. The balance training wheel device comprises a U-shape bracket member having a first leg mounted to the roller wheel mounting means and a second leg upon which there is mounting the training wheel, the bracket member further comprising a connecting member joining the legs. The first leg of the bracket is attached to the roller wheel mounting means by an axle of a roller wheel. The first leg of the bracket member defines an elongated slot for adjustable attachment to roller wheel axles over a range of separation distances of adjacent of the axles. The leg of the U-shaped wheel well member mounted to the roller wheel mounting means includes a first aperture for attachment to a first roller wheel axle and an elongated slot for attachment to a second roller wheel axle over a range of separations of the axles. The training wheel is supported on the leg of the U-shaped wheel well member opposite the leg attached to the roller wheel mounting means. The axis of rotation of the training wheel is above the axis of the roller wheels with respect to the travel surface. The training wheel is the same diameter as the roller wheels. The connecting member defines an aperture for extension of the training wheel therethrough, thereby to. accommodate training wheels of various diameters.

According to another aspect of the invention, a balance training apparatus for use under a roller skate having a series of in-line wheels positioned beneath the users foot comprises a U-shaped wheel well means having first and second leg members and a connecting member, the wheel-well member being attached to the tandem roller skate for positioning a training wheel adjacent the roller wheels for rotation about an axis parallel with the axis of the roller wheel rotation and along a parallel, nonintersecting line of travel to the roller wheels when the roller wheels engage a travel surface at an acute angle.

Preferred embodiments of this aspect of the invention may include one or more of the following additional features. One leg of the U-shaped wheel well member includes a first aperture for attachment to a first roller wheel axle and a slot for attachment to a second roller wheel axle over a range of separations of the axles. The U-shaped wheel well member has an aperture in the connecting member of the U-shaped wheel well member for extension of the training wheel therethrough, to accommodate training wheels of various diameters.

According to still another aspect of the invention, a balance training kit for a roller skate having a series of in-line roller wheels positioned on axles beneath user's foot for rotation in a first common plane for movement along a travel surface comprises an elongated replacement axle for replacement of a roller axle, the replacement axle extending laterally beyond the line of the in-line roller wheels, and a removable, U-shaped wheel well means comprising first and second leg members, a connecting member extending therebetween, and a training wheel. The wheel-well is adapted for removable attachment to the roller skate by mounting a leg of the wheel well means on the elongated replacement axle. The wheel well means is adapted for positioning the training wheel adjacent the rollers for rotation of the training wheel in a second training plane, the second plane lying parallel to the first plane, the training wheel disposed to rotate about an axis parallel with the axes of rotation of the roller wheels and in the second plane along a training line on the travel surface parallel and nonintersecting with the travel line, the training wheel being spaced from the travel surface when the first common roller plane is generally perpendicular to the travel surface, and adapted to engage the travel surface when the first common roller plane achieves a predetermined acute angle to the travel surface, thereby to aid a user to maintain balance.

It is an object of this invention to assist newcomers to the sport to more easily become acclimated to tandem roller skating by providing means to assist the skater to maintain the balance with less risk of falling.

These and other features and advantages of the invention will be seen from the following description of a presently preferred embodiment, and from the claims.

DESCRIPTION OF A PRESENTLY PREFERRED EMBODIMENT

We first briefly describe the drawings.

Figure 1:
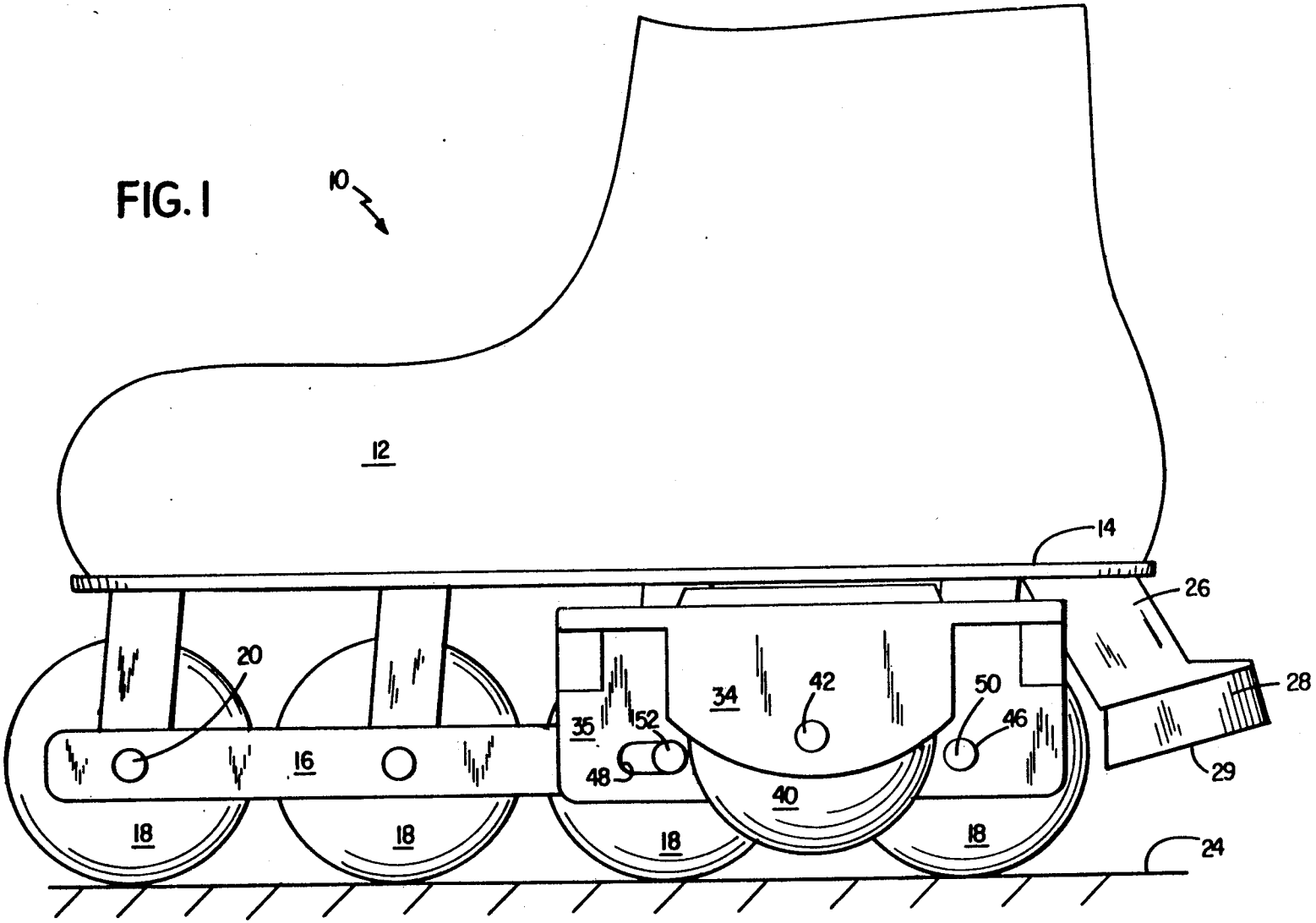
FIG. 1 is a side view of a tandem roller skate equipped with a .training wheel device of the invention.
Figure 2:
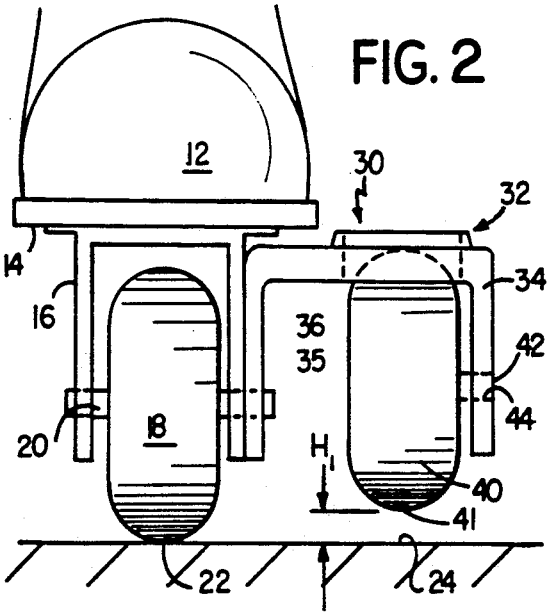
FIG. 2 is a front view of the tandem roller skate of FIG. 1 positioned with the travel rollers in substantially vertical orientation.
Figure 2A:
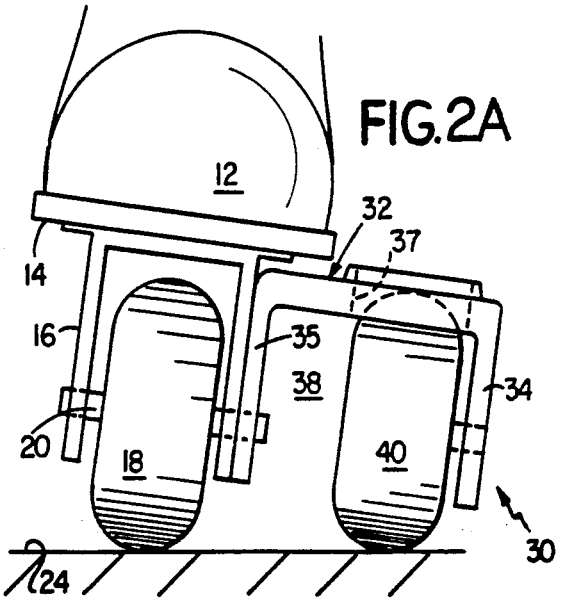
Figure 3:
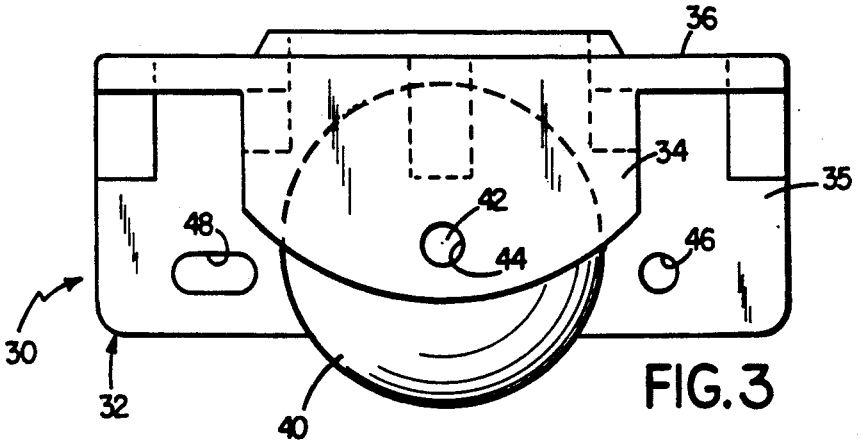
Figure 4:
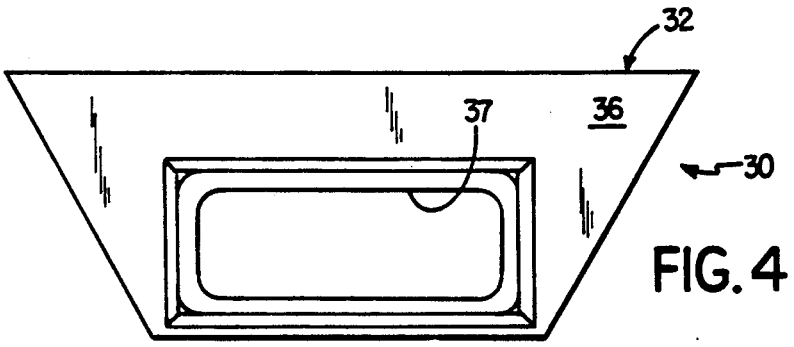

FIG. 2*a* is a similar view of the tandem roller skate of FIG. 1 positioned with the travel rollers at an acute angle so as to engage the training wheel upon the travel surface to assist in maintaining balance; and FIGS. 3 and 4 are side and top views, respectively, of the training wheel device of the invention.

Referring to FIG. 1, a typical tandem roller skate 10 has a boot 12 and a foot support or sole 14. A roller wheel frame 16 attached beneath the sole, e.g. by screws or rivets (not shown), mounts a series of roller wheels 18 in-line or tandem, on parallel axles 20, to maintain parallel axes of rotation for the wheels and define a single line travel line 22 on a travel surface 24 (FIG. 2). A stop or brake arm 26 with pad 28 extends to the rear of the boot and has a friction stopping surface 29 which may be brought into contact with the travel surface 24 by the user tipping the boot to the rear.

Referring also to FIGS. 2 and 2*a*, the training wheel device 30 of the invention consists of a U-shaped bracket 32 having a pair of down-pending legs 34, 35 joined by a horizontal connecting member 36 which together define a wheel-well 38. A single training wheel 40 is mounted upon an axle 42 extending fixedly through an aperture 44 in the outer bracket leg 34. The inner bracket leg 35 defines a pair of apertures 46, 48 for attachment of the training wheel device 30 to the wheel frame 16 of the skate. To mount the device 30, substitute axle bolts 50, 52 (FIG. 1) of extended length are provided in place of axle bolts 20 on the roller wheels in the region of the training wheel device 30 and extend through apertures 46, 48. The rear aperture 46 is typically positioned coaxially with the axle of the rear-most roller wheel 18. The front aperture 48 has the form of an elongated slot to accommodate a range of tandem roller skate sizes having different spacing between adjacent roller wheel axles.

Referring again to FIG. 2, typically, the training wheel 40 is positioned with its bottom surface 41 spaced at a distance $H_1$, e.g. about 0.25 inch, above the travel surface 24 when the foot surface or sole 14 of the tandem roller skate 10 is generally horizontal with the surface and the travel rollers 18 are positioned generally vertically. The training wheel bracket connecting member 36 defines an aperture 37, which permits larger diameter wheels to be mounted in the wheel-well 38 with the large wheel extending through aperture 37, thereby allowing variation of the height $H_1$ by changing wheel diameter. This feature is of particular advantage in that the user may vary the height, $H_1$, as needed, and as balance acclimation improves. In addition, roller wheels of conventional size may be provided, obviating the cost of special manufacturing.

In particular embodiments, the training wheel 40 is of the same diameter as travel roller wheels 18, and the training wheel axle 42 extending through aperture 44 is positioned at a predetermined height $H_1$ above the axis of the roller wheels.

As shown in FIG. 2, when the tandem roller skate 10 is in a position with the travel rollers 18 generally vertical to the travel surface 24, the training wheel 40 does not contact the surface, thus allowing the user to skate normally. As shown in FIG. 2*a*, in the event that the user begins to lose balance, causing the roller wheels 18 to begin to tip at an acute angle with respect to the surface 24, the lower surface 41 of the training wheel 40 is brought into engagement with, and rotates upon, the surface 24 along a training wheel line parallel and nonintersecting with the travel line, thereby to support the user and allow sufficient time for recovery of balance, thus to avoid a fall.

Referring now to FIGS. 3 and 4, in a particular embodiment of the training wheel device 30 of the invention, the aperture 34 may include a raised border 35 that tapers inward as shown to deflect debris from the surface thrown up form the training wheel. The axles preferably are removeably fastened to allow easy removal of the training device when not needed by the user. Similarly, the training wheel axle 42 is removeably fastened to allow the user to remove and replace training wheels of different sizes, as discussed above.

Other embodiments are within the following claims. For example, the training device may be mounted on one or both skates, and on the inside or outside of the skate, as desired by the user.

What is claimed is:

1. A training wheel device for use with a tandem or in-line roller skate having a series of travel rollers disposed for travel along a travel surface in a single travel line, the tandem roller skate further comprising a travel roller bracket, the travel rollers being mounted for rotation on parallel travel roller axles mounted on the travel roller bracket, said training wheel device comprising:

a training wheel bracket, a training wheel mounted upon said bracket, and means for mounting said device upon the tandem roller skate, said means for mounting said device upon the tandem roller skate comprising at least two elongated travel roller axles and said training wheel bracket defining at least a pair of apertures for receiving said elongated travel roller axles therethrough, at least one said aperture of said at least a pair of apertures comprising an elongated slot to accommodate a range of distances between said at least two elongated travel roller axles, said training wheel adapted to engage upon the travel surface for travel in a balance line to enhance the balance of a user, the balance line being spaced from and generally parallel to the travel line of the travel rollers.

2. The training wheel device of claim 1 wherein said training wheel defines a wheel surface, and in a first position of the tandem roller skate with the travel rollers disposed in a plane generally vertical to a travel surface, said wheel surface is spaced from engagement with the travel surface, and in a second position of the tandem roller skate with the travel rollers disposed in a plane at a predetermined angle of inclination to a plane of the travel surface, said wheel surface is engaged upon said travel surface for enhanced user balance.

3. The training wheel device of claim 1 wherein said bracket comprises a u-shaped member having a first leg, a second leg and a connecting member extending therebetween.

4. The training wheel device of claim 3 wherein said u-shaped member defines a wheel well and said training wheel is mounted for rotation therein.

5. The training wheel device of claim 1 wherein the training wheel is the same diameter as said roller wheels.

6. A training wheel device for use with a tandem or in-line roller skate having a series of travel rollers disposed for travel along a travel surface in a single travel line, said training wheel device comprising:

a training wheel bracket comprising a u-shaped member having a first leg, a second leg and a connecting member extending therebetween, a training wheel mounted upon said bracket, and means for mounting said device upon the tandem roller skate, said training wheel adapted to engage upon the travel surface for travel in a balance line to enhance the balance of a user, the balance line being spaced from the generally parallel to the travel line of the travel rollers, and said connecting member defining an aperture for extension of said training wheel therethrough, thereby to accommodate training wheels of various diameters.

7. A personal roller transportation apparatus, comprising:

a tandem roller skate having a foot sole member for supporting a user's foot, and a roller wheel mounting means for positioning a plurality of roller wheels in tandem in a first common roller plane beneath said foot sole member, said roller wheels being mounted on axles to maintain parallel axes for rotation in said first common roller plane along a travel line upon a travel surface, said travel line being generally centered with respect to said foot; and a balance training wheel device attached to said tandem roller skate for positioning a training wheel adjacent said roller wheels for rotation of said training wheel in a second training plane, said second plane lying parallel to said first plane, said training wheel disposed to rotate about an axis parallel with the axes of rotation of said roller wheels and in said second plane along a training line on said surface parallel and nonintersecting with said travel line, said training wheel being spaced from the travel surface when said first common roller plane is generally perpendicular to the travel surface, and adapted to engage the travel surface when said first common roller plane achieves a predetermined acute angle to the travel surface, thereby to aid a user to maintain balance, said balance training wheel device comprising a U-shaped bracket member having a first leg mounted to said roller wheel mounting mean sand a second leg upon which there is mounting said training wheel, said bracket member further comprising a connecting member joining said legs, said first leg of said bracket being attached to said roller wheel mounting means by axles of at least two roller wheels and said first leg of said bracket member defining an elongated slot for adjustable attachment to roller wheel axles over a range of separation distances of adjacent of said axles.

8. The apparatus of claim 7 wherein the axis of rotation of said training wheel is above the axis of said roller wheels with respect to the travel surface.

9. The apparatus of claim 7 wherein the training wheel is the same diameter as said roller wheels.

10. A personal roller transportation apparatus, comprising:

a tandem roller skate having a foot sole member for supporting a user's foot, and a roller wheel mounting means for positioning a plurality of roller wheels in tandem in a first common roller plane beneath said foot sole member, said roller wheels being mounted on axles to maintain parallel axes for rotation in said first common roller plane along a travel line upon a travel surface, said travel line being generally centered with respect to said foot; and a balance training wheel device attached to said tandem roller skate for positioning a training wheel adjacent said roller wheels for rotation of said training wheel in a second training plane, said second plane lying parallel to said first plane, said training wheel disposed to rotate abut an axis parallel with the axes of rotation of said roller wheels and in said second plane along a training line on said surface parallel and nonintersecting with said travel line, said training wheel being spaced from the travel surface when said first common roller plane is generally perpendicular to the travel surface, and adapted to engage the travel surface when said first common roller plane achieves a predetermined acute angle to the travel surface, thereby to aid a user to maintain balance, said balance training wheel device comprising a U-shape bracket member having a first leg mounted to said roller wheel mounting means and a second leg upon which there is mounting said training wheel, said bracket member further comprising a connecting member joining said legs, said leg of said U-shaped bracket member mounted to said roller wheel mounting means including a first aperture for attachment to a first roller wheel axle and an elongated slot for attachment to a second roller wheel axle over a range of separations of said axles.

11. The apparatus of claim 10 wherein said training wheel is supported on the leg of said U-shaped wheel well member opposite said leg attached to said roller wheel mounting means.

12. The apparatus of claim 10 wherein the axis of rotation of said training wheel is above the axis of said roller wheels with respect to the travel surface.

13. The apparatus of claim 10 wherein the training wheel is the same diameter as said roller wheels.

14. A personal roller transportation apparatus, comprising:

a tandem roller skate having a foot sole member for supporting a user's foot, and a roller wheel mounting means for positioning a plurality of roller wheels in tandem in a first common roller plane beneath said foot sole member, said roller wheels being mounted on axles to maintain parallel axes for rotation in said first common roller plane along a travel line upon a travel surface, said travel line being generally centered with respect to said foot; and a balance training wheel device attached to said tandem roller skate for positioning a training wheel adjacent said roller wheels for rotation of said training wheel in a second training plane, said second plane lying parallel to said first plane, said training wheel disposed to rotate about an axis parallel with the axes of rotation of said roller wheels and in said second plane along a training line on said surface parallel and nonintersecting with said travel line, said training wheel being spaced from the travel surface when said first common roller plane is generally perpendicular to the travel surface, and adapted to engage the travel surface when said first common roller plane achieves a predetermined acute angle to the travel surface, thereby to aid a user to maintain balance, said balance training wheel device comprising a U-shape bracket member having a first leg mounted to said roller wheel mounting means and a second leg upon which there is mounting said training wheel, said bracket member further comprising a connecting member joining said legs, said connecting member defines an aperture for extension of said training wheel therethrough, thereby to accommodate training wheels of various diameters.

15. The apparatus of claim 14 wherein the axis of rotation of said training wheel is above the axis of said roller wheels with respect to the travel surface.

16. The apparatus of claim 14 wherein the training wheel is the same diameter as said roller wheels.

17. A balance training apparatus for use under a roller skate having a series of in-line wheels positioned beneath the users foot, comprising:

a U-shaped wheel well member having first and second leg members and a connecting member, said wheel-well member being attached to said tandem roller skate for positioning a training wheel adjacent said roller wheels for rotation about an axis parallel with the axis of said roller wheel rotation and along a parallel, nonintersecting line of travel to said roller wheels when said roller wheels engage a travel surface at an acute angle, one leg of said U-shaped member including a first aperture for attachment to a first roller wheel axle and a slot for attachment to a second roller wheel axle over a range of separations of said axles.

18. A balance training apparatus for use under a roller skate having a series of in-line wheels positioned beneath the users foot, comprising:

a U-shaped wheel well member having first and second leg members and a connecting member, said wheel-well member being attached to said tandem roller skate for positioning a training wheel adjacent said roller wheels for rotation about an axis parallel with the axis of said roller wheel rotation and along a parallel, nonintersectign line of travel to said roller wheels when said roller wheels engage a travel surface at an acute angle, said U-shaped member having an aperture in the connecting member of said U-shaped wheel well member for extension of said training wheel therethrough, to accommodate training wheels of various diameters.

* * * * *